US006625853B2

(12) United States Patent
Edvardsson et al.

(10) Patent No.: US 6,625,853 B2
(45) Date of Patent: Sep. 30, 2003

(54) METHOD OF COMPRESSING FIBROUS BODIES

(75) Inventors: Gunnar Edvardsson, Bohus Bjorko (SE); Claes Göransson, Landvetter (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 10/244,683

(22) Filed: Sep. 17, 2002

(65) Prior Publication Data

US 2003/0070270 A1 Apr. 17, 2003

Related U.S. Application Data

(60) Provisional application No. 60/322,437, filed on Sep. 17, 2001.

(51) Int. Cl.[7] ..... D04H 1/44; B31F 1/00

(52) U.S. Cl. ..... 28/116; 28/134; 28/135

(58) Field of Search ..... 28/116, 134, 135, 28/136, 137, 138, 117, 118, 122, 123, 165; 26/18.5, 18.6, 27; 156/196, 285, 582; 264/280, 294, 296, 310, 319, 320, 324

(56) References Cited

U.S. PATENT DOCUMENTS

| | | | | | |
|---|---|---|---|---|---|
| 1,533,349 | A | * | 4/1925 | Genest | 28/136 |
| 1,535,324 | A | * | 4/1925 | Lorenze | 28/136 |
| 1,535,326 | A | * | 4/1925 | Lorenz | 28/136 |
| 1,535,327 | A | * | 4/1925 | Genest | 28/136 |
| 2,708,303 | A | * | 5/1955 | Walton et al. | 28/122 |
| 2,881,505 | A | * | 4/1959 | Hoffman | 28/134 |
| 3,857,657 | A | * | 12/1974 | Teed | 28/118 |
| 4,753,693 | A | | 6/1988 | Street | 156/62.8 |
| 5,114,062 | A | * | 5/1992 | Kuhn et al. | 226/95 |
| 5,548,946 | A | * | 8/1996 | Holub | 156/582 |

FOREIGN PATENT DOCUMENTS

| | | |
|---|---|---|
| DE | 1 474 973 | 9/1969 |
| EP | 0 369 974 | 5/1990 |
| GB | 1 577 882 | 10/1980 |
| SE | 468 851 | 3/1993 |
| WO | 00/23366 | 4/2000 |

* cited by examiner

*Primary Examiner*—Amy B. Vanatta
(74) *Attorney, Agent, or Firm*—Young & Thompson

(57) ABSTRACT

A method of compressing fibrous bodies which are held in place on a perforated support by means of negative pressure. Each fibrous body to be compressed is arranged on a first support that includes parts with and without perforations. A first compression of the fibrous body is then brought about over the part without perforations. The partly compressed fibrous body is then transferred to a second support which includes perforations in a part covered by compressed portions of the fibrous body and a part without perforations covered by uncompressed portions of the fibrous body. A second compression of the fibrous body is brought about in those portions of the fibrous body which cover the part without perforations of the second support.

5 Claims, 1 Drawing Sheet

METHOD OF COMPRESSING FIBROUS BODIES

TECHNICAL FIELD

Figure 2:
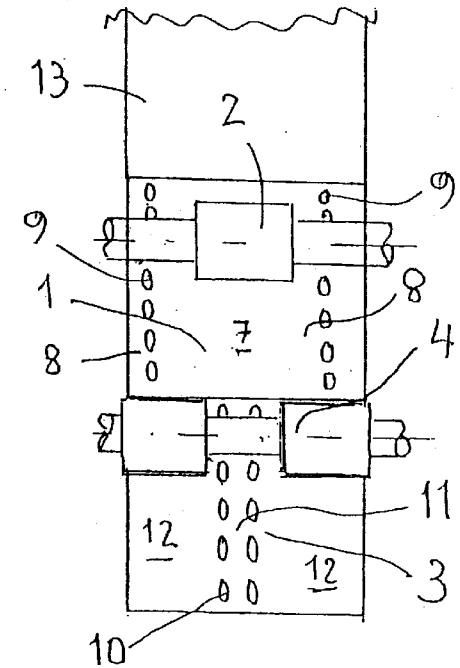

The present invention relates to a method of compressing fibrous bodies which are held in place on a perforated support by means of negative pressure, and to an arrangement for implementing the method.

BACKGROUND OF THE INVENTION

In the manufacture of absorbent articles, such as diapers, incontinence pads, sanitary towels, panty liners and the like, use is commonly made of fluff pulp, with or without the addition of superabsorbents, bonding fibres or other materials, as the absorbent layer. The fluff pulp is supplied to a mat former or the like and is given the desired shape. The shaped pulp body is then compressed so as to obtain the desired absorption properties. The pulp bodies are often conveyed on perforated conveying tracks and are held in place on the conveying tracks by means of negative pressure. In the case of continuous process lines for the manufacture of absorbent articles, a number of individual absorbent bodies or layers of absorbent material are often put onto a running web of surface layer material, and it is of course of utmost importance for manufacturing accuracy that the individual bodies or layers end up in the correct place on the running web.

One problem associated with compressing pulp bodies which are held in place by means of negative pressure on a perforated support is that, during compression, the fluff pulp is pressed into the perforations and remains in these after the compressed pulp body has been removed from the support. This problem is particularly marked when pulp bodies are compressed hard, that is to say pulp bodies are compressed to a density >200 kg/m$^3$, which means that there is a great risk of the perforations in the support being clogged or blocked after only one or a few compressions. After the perforations of the support have become clogged, it must be cleaned in order to be capable of being used again in the process line, which leads to operational stoppages or to the introduction of complicated cleaning arrangements into the process line. Clogging also means that the pulp bodies can move on the support, which results in defective products.

The object of the present invention is to eliminate completely the risk of blocking of the perforations in the support when pulp bodies are compressed.

SUMMARY OF THE INVENTION

According to the invention, this object is achieved by means of a method of compressing fibrous bodies which are held in place on a perforated support by means of negative pressure, characterized in that each fibrous body to be compressed is first arranged on a first support which comprises parts with and without perforations within the region covered by the fibrous body, in that a first compression of the fibrous body is brought about in those portions thereof which cover the part or parts without perforations of the first support, in that the partly compressed fibrous body is then transferred to a second support which comprises perforations in the part or parts covered by compressed portions of the fibrous body but is without perforations within one or more parts covered by uncompressed portions of the fibrous body, in that a second compression of the fibrous body is brought about when the latter is placed on the second support in those portions of the body which cover the part or parts without perforations of the second support, after which, if required, similar compression steps are repeated until all portions to be compressed of the fibrous body have been compressed.

In a preferred embodiment, the supports consist of running conveying tracks, and the fibrous bodies are retained on the first support in two lateral regions extending in the running direction and are retained on the second support in a central region extending in the running direction.

The invention also relates to an arrangement for compressing fibrous bodies, characterized by a first conveying track which is perforated in one or more regions extending in the running direction of the conveying track and interacts with one or more vacuum boxes so that a negative pressure is formed on the load-carrying side of the conveying track in its perforated region or regions, a first compression arrangement through which the first conveying track runs and which is arranged so as to compress a body conveyed on the first conveying track in those parts of the body which are located in unperforated regions of the first conveying track, a second conveying track which is perforated in one or more regions extending in the running direction of the conveying track, which regions correspond in the transverse direction to the unperforated regions of the first conveying track, and interacts with one or more vacuum boxes so that a negative pressure is formed on the load-carrying side of the second conveying track in its perforated region or regions, and a second compression arrangement through which the second conveying track runs and which is arranged so as to compress a body conveyed on the second conveying track in those parts of the body which are located in unperforated regions of the second conveying track.

In a preferred embodiment, the first and second compression arrangements consist of compression rollers, and the first and second conveying tracks consist of transfer wheels.

LIST OF FIGURES

Figure 1:
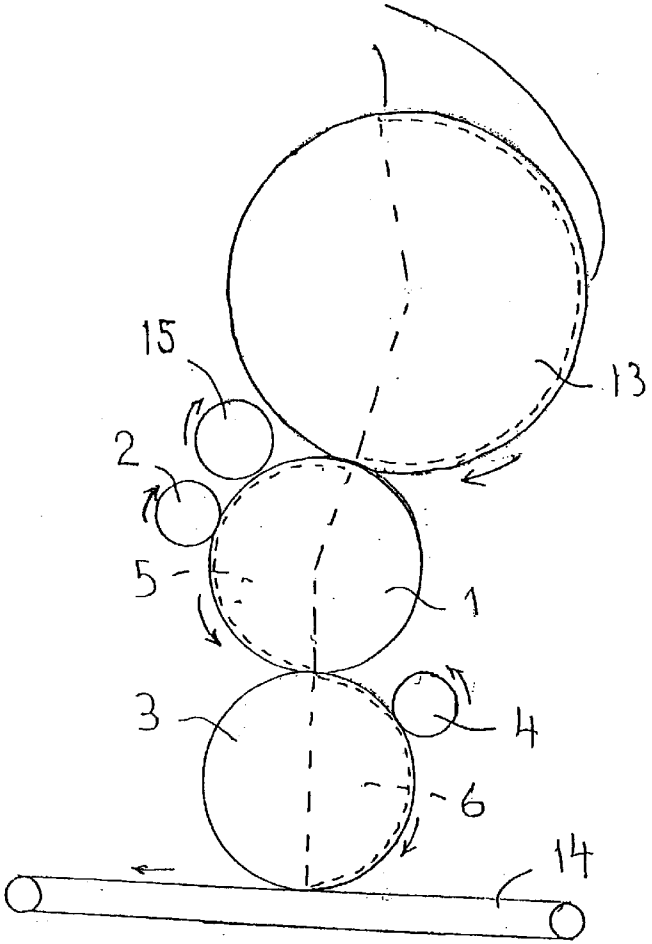

The invention will now be described with reference to accompanying figures, where:

FIG. 1 shows diagrammatically a side view of a compression arrangement in a first embodiment of the invention, and FIG. 2 shows a plan view of the arrangement in FIG. 1.

DESCRIPTION OF EMBODIMENTS

The compression arrangement shown in FIGS. 1 and 2 comprises a first transfer wheel 1, a first compression roller 2 interacting with the transfer wheel 1, a second transfer wheel 3 and a compression roller 4 interacting with the transfer wheel 3. The directions of rotation of the transfer wheels and the compression rollers interacting with these are indicated by arrows in FIG. 1.

The transfer wheels 1 and 3 comprise in a customary manner perforated or holed peripheral surfaces and stationary vacuum boxes 5, 6 which, in the circumferential direction, extend over that region of the circumference of the wheel through which pulp bodies are conveyed and are retained against the peripheral surface by means of the negative pressure generated by means of the vacuum box.

In accordance with the invention, the peripheral surface of the transfer wheel 1 has a central region 7 without holes or perforations, which, in the circumferential direction, extends around the entire periphery of the transfer wheel, while the regions 8 outside the central region 7 are provided with a pattern of holes 9 extending around the entire periphery of the transfer wheel. In the embodiment shown in the figures, the pattern consists of a row of individual holes 9 but the pattern can also consist of a number of parallel rows of holes, and the rows can also be displaced in the circumferential direction relative to one another. The individual holes can have any shape and can also be provided with netting which divides each individual hole 9 into a number of smaller holes. The individual holes suitably have an area of 3–20 $mm^2$, and the open area of the regions 8 should lie between 2 and 25%.

The first compression roller 2, which interacts with the transfer wheel 1, is dimensioned and positioned in such a manner that it acts in only the central region 7 of the peripheral surface of the transfer wheel 1.

The second transfer wheel 3 differs from the first transfer wheel 1 in having perforations 10 in its central region 11, which corresponds to the central region 7 without perforations of the first transfer wheel 1, and being without perforations in the regions 12 lying outside the central region 11, which correspond to the perforated regions 8 of the transfer wheel 1. The second transfer wheel 3 therefore has a central perforated region 11 and two lateral regions 12 without perforations. Otherwise, the transfer wheel 3 is constructed in the same manner as the transfer wheel 1.

The regions 7, 12 without perforations can of course be brought about on a fully perforated transfer wheel by covering these regions with a layer of an impermeable material or blocking the holes in these regions in another manner.

The second compression roller 4 extends axially over the entire width of the peripheral surface of the second transfer wheel 3 and has a central cutout in its central part, that is to say that part of it which extends over the width of the central region 11 of the transfer wheel 3.

FIG. 1 also shows a mat-forming wheel 13, from which a succession of airlaid pulp bodies is deposited on the first transfer wheel 1, and a conveyor 14, on which a succession of finished compressed pulp bodies is placed and transferred to a process line (not shown) for the manufacture of absorbent articles. FIG. 1 also shows a precompression roller 15 which can advantageously be arranged so as to remove air from the pulp bodies before the actual compression. A precompression roller can also be arranged so as to interact with the second transfer wheel 3 and is then positioned in front of the compression roller 4 in the running direction.

The arrangement functions as described below.

In a customary manner, the mat-forming wheel has along its periphery a number of moulds with perforated bottoms and a vacuum box which generates a negative pressure below these bottoms as the bottoms pass by one or more mat-forming covers and onward to that point along the periphery at which the pulp bodies formed are deposited on the transfer wheel 1. The mat-forming covers supply a stream of airborne pulp fibres, to which fibres or particles of superabsorbent material or bonding fibres may be added. When the moulds of the mat-forming wheel pass below the mat-forming cover, pulp fibres are sucked into the moulds, individual pulp bodies of the desired shape being formed.

After transfer of these pulp bodies to the transfer wheel 1, the bodies are held in place on the peripheral surface of the wheel 1 by means of the negative pressure which acts on the bodies in the perforated regions 8 of the transfer wheel 1. On passing the precompression roller 15, some compression of the bodies takes place, and some air is pressed out of these. After precompression, the pulp bodies have a density of roughly 100 $kg/m^3$. The bodies are then fed past the first compression roller 2, compression of the bodies taking place in their central part, which runs under the first compression roller 2. By virtue of the fact that, during this compression, the material of the pulp bodies is pressed against only that part 7 of the peripheral surface of the transfer wheel 1 which has no holes, there is of course no risk of the holes 9 in the regions 8 of the peripheral surface of the transfer wheel being blocked or clogged during this compression step.

The pulp bodies compressed in their central part are then transferred to the second transfer wheel 3 and, on passing the second compression roller 4, compression of the pulp bodies takes place in their lateral parts, which pass under those parts of this roller which extend outside the perforated central region 11 of the peripheral surface of the transfer wheel 3. The widths of the first and second compression rollers 2 and 4 are selected so that the whole of the pulp bodies has been compressed after a pulp body has passed the second compression roller 4. The width of the first compression roller 2 is preferably slightly greater than the width of the central cutout of the second compression roller 4, suitably 2 mm greater, so as to ensure that the pulp bodies are compressed over their entire width. After passing the second compression roller 4, the compression of the pulp bodies is finished, and they can be supplied via the conveyor belt 14 to a material web forming part of a process line (not shown) for manufacturing absorbent articles.

If the peripheral speed of the second transfer wheel 3 is synchronous with the feed speed in such a process line, that is to say the pulp bodies can be deposited in succession with the desired mutual spacing, the finished compressed pulp bodies can be supplied directly to the process line for manufacturing absorbent articles.

By virtue of the pulp in the pulp bodies being pressed against only an unperforated support during the compression steps, the compression cannot lead to blocking of the perforations in the peripheral surfaces of the first and second transfer wheels 1 and 3.

In the arrangement described, the pulp bodies are compressed to the same density in all their parts, that is to say the nips of the first and second compression rollers and the transfer wheels interacting therewith are the same size. However, there is nothing to prevent the nips being given different sizes so that the density in the central parts of the finished compressed pulp bodies differs from the density in lateral parts. It is also possible to make use of profiled rollers in order to give the pulp bodies different density in different parts. The essential factor for the invention is that all compression of the pulp bodies takes place against a support which does not have holes.

The method and arrangement described can of course be modified within the scope of the invention. For example, the transfer wheels 1 and 3 and the compression rollers interacting therewith can change places. Furthermore, additional compression steps can be performed, for example in order to produce compression lines in the pulp body formed, these compression steps also being performed in such a manner that pulp is pressed against only unperforated supports. Moreover, linear conveyor belts can be used instead of transfer wheels, and the method can also be applied to intermittently running conveying tracks and intermittently acting compression means. Instead of a common vacuum box for the perforated lateral regions of the first transfer wheel, a separate vacuum box can be provided for each perforated region. The method can also be used with continuous fibrous mats, and the fibrous bodies or the fibrous mat do(es) not have to be produced by airlaying. The invention is therefore to be limited only by the content of the accompanying patent claims.

What is claimed is:

1. A method of compressing a fibrous body which is held in place on a perforated support by means of negative pressure, comprising the steps of:

arranging the fibrous body to be compressed on a first support which comprises parts with and without perforations within the region covered by the fibrous body;

performing a first compression of the fibrous body in those portions thereof which cover the part without perforations of the first support;

transferring the partly compressed fibrous body to a second support which comprises perforations in a part covered by compressed portions of the fibrous body but is without perforations within parts covered by uncompressed portions of the fibrous body; and performing a second compression of the fibrous body when the fibrous body is placed on the second support in those portions of the body which cover the part without perforations of the second support.

2. The method according to claim 1, wherein the supports have running conveying tracks, and the fibrous bodies are retained on the first support in two lateral regions extending in a running direction of the tracks and are retained on the second support in a central region extending in the running direction.

3. An arrangement for compressing fibrous bodies, comprising:

a first conveying track which is perforated in one or more regions extending in a running direction of the first conveying track and interacts with one or more vacuum boxes so that a negative pressure is formed on a load-carrying side of the first conveying track in its perforated region or regions;

a first compression arrangement through which the first conveying track runs and which is arranged so as to compress a body conveyed on the first conveying track in those parts of the body which are located in unperforated regions of the first conveying track;

a second conveying track which is perforated in one or more regions extending in a running direction of the second conveying track, which regions correspond in a transverse direction to unperforated regions of the first conveying track, and interacts with one or more vacuum boxes so that a negative pressure is formed on a load-carrying side of the second conveying track in its perforated region or regions; and a second compression arrangement through which the second conveying track runs and which is arranged so as to compress a body conveyed on the second conveying track in those parts of the body which are located in unperforated regions of the second conveying track.

4. The arrangement according to claim 3, wherein the first and second compression arrangements comprise compression rollers.

5. The arrangement according to claim 4, wherein the first and second conveying tracks comprise transfer wheels.

* * * * *